United States Patent [19]

Noszticzius et al.

[11] 4,332,664

[45] Jun. 1, 1982

[54] GAS PRODUCING ELECTROLYTIC CELL FOR PORTABLE DEVICES

[75] Inventors: Zoltán Noszticzius; Károly Oláh; Zsófia Vajta; György Pálmai; Gábor Patonay; Ferenc Szommer, all of Budapest, Hungary

[73] Assignee: Csepel Muvek Hiradastechnikai Gepgyara, Budapest, Hungary

[21] Appl. No.: 185,407

[22] Filed: Sep. 9, 1980

[51] Int. Cl.[3] ..... C25B 9/00; C25B 15/08

[52] U.S. Cl. ..... 204/266; 204/271

[58] Field of Search ..... 204/266, 271, 258

[56] References Cited

U.S. PATENT DOCUMENTS

| | | | |
|---|---|---|---|
| 3,623,970 | 11/1971 | Haas | 204/266 X |
| 3,761,382 | 9/1973 | Hammond et al. | 204/266 |
| 3,928,150 | 12/1975 | Rahn et al. | 204/266 X |
| 3,933,614 | 1/1976 | Bunn, Jr. | 204/266 |
| 4,002,552 | 1/1977 | Bunn, Jr. et al. | 204/266 |

FOREIGN PATENT DOCUMENTS

| | | |
|---|---|---|
| 470931 | 1/1929 | Fed. Rep. of Germany . |
| 541563 | 12/1931 | Fed. Rep. of Germany . |
| 371096 | 8/1963 | Switzerland . |

*Primary Examiner*—Delbert E. Gantz
*Assistant Examiner*—Donald R. Valentine
*Attorney, Agent, or Firm*—Young & Thompson

[57] ABSTRACT

A gas producing electrolytic cell for portable devices comprising a vessel, an electrolyte, a cap, a gas space, channel labyrinths, a separating wall and contacts. The channel labyrinths eliminate the outflow of the electrolyte from the cell in its overturned position, tender the return of electrolyte to the vessel, to the original level possible. The contacts can be inundated by the electrolyte and in this way an outer electric circuit can be closed for cutting out the stream of electrolyse and for signalizating the overturned position of the cell.

8 Claims, 5 Drawing Figures

GAS PRODUCING ELECTROLYTIC CELL FOR PORTABLE DEVICES

BACKGROUND OF THE INVENTION

The present invention relates to a gas producing electrolytic cell for portable devices, which contains a vessel, an electrolyte, a separating wall, a cap, channel labyrinths and contacts. The presently invented electrolytic cell is usable in portable devices, particularly in devices for air pollution control.

It is known that many technical fields (for example the gas chromatography, the laboratory reactors, the measure monitors for air pollution control etc.) need a stable and adjustable volume flow of a pure gas, particularly of hydrogen. In the laboratories gas cylinders are used which contain a gas of great purity. The disadvantage of this solution lies in that the place of the use and of the storage of the cylinders must be chosen so as to fulfil some very stringent fire and other safety rules. The recharge and the exchange of the empty cylinders are accompanied by other problems. In the cylinders the gases can be kept in the required purity only during a relatively short time.

The above mentioned difficulties involved in the use of gas cylinders can be avoided by exploitation of gas producing electrolytic cells. These electrolytic cells produce different gases of great purity. For example, the flame detectors need gaseous hydrogen of great purity that can be produced from water by electrolysis thereof in the so called hydrogen generators. The hydrogen generators can be characterized by a great reliability, by a low flammability and they require only to be supplied by an electric current and periodic made-up by an electrolyte (for example, a well-defined quantity of water must be added once a week). The quantity of the produced gas can be adjusted in a very simple way, by setting the electric current of the electrolysis.

Hydrogen generators were developed also for chromatographic investigations. These devices can be used in measuring equipment for air pollution control, too. (For example, a hydrogen generator is used in a monitor of "Fidas" type produced by Hartmann-Braun Corp.). These generators are usable only in stationary equipment, particularly having great dimensions, because of the main disadvantage of the gas producing electrolytic cells that they are sensative to shaking and moving: in case of their accidental overturning the electrolyte flows into and inundates the gas guiding orifice of the cell. The produced gas can press out the electrolyte from this orifice and the alkaline or acidic liquid may ruin the cell or the equipment comprising the cell.

Therefore the portable devices are supplied generally by gas from gas bottles. For example, in a flame detector of Perkin—Elmer Corp. or in a similar Hungarian device of "Carbidet" type a gas bottle serves as a hydrogen source.

SUMMARY OF INVENTION

An aim of the invention is to develop a gas producing electrolytic cell from which the electrolyte can not flow out in case of an accidental overturning of the cell and thereby the danger of the ruin of the cell or of other equipment comprising the cell may be avoided.

An object of the invention is a gas producing electrolytic cell for portable devices, which comprises a vessel, an electrolyte filling a part of the inner volume of the vessel, a cap covering the vessel, a gas space being formed in the vessel by an anode space and a cathode space over the electrolyte, wherein the improvement lies in that gas guiding channel labyrinths are situated in the upper part of the vessel and in the channel labyrinths or on the cap on the side of the gas space contacts are placed for sensing the presence of the electrolyte.

In an advantageous embodiment of the presently invented electrolytic cell the channel labyrinths comprise input and output orifices situated on the opposite rims of the cap, and the channel labyrinths are shaped in the form of vertical and horizontal or skew elements bounding the input and output orifices.

In an other advantageous embodiment of the proposed electrolytic cell the input orifice of the channel labyrinths is placed respectively over the cathode space and over the anode space in the vicinity of a respective corner of the cap, the output orifice is placed respectively over the anode space and over the cathode space, in the vicinity of a respective corner of the cap, oppositely to the input orifice.

The electrolytic cell contains the electrolyte generally only up to the half of its height for forming a gas space over the electrolyte. The gas space is suitable for compensating the pressure failures in the cathode space and in the anode space. In the case of an accidental overturning of the presently invented electrolytic cell or the device comprising a such a cell the electrolyte inundates only a part of the channel labyrinths but it can not reach the level of the output orifices, because its level remains lower.

The cross-section and the path of the channel labyrinths can be chosen variously between the input and the output orifices. The channel labyrinths can be constructed on the basis of direct tubes or of tube sections having different directions. The form of the channel labyrinths need fulfil only one condition: from the labyrinth the electrolyte must return to the vessel after returning the cell from overturned to the original position. Advantageously every inner dimension of the tube sections will be chosen to be greater than 3 mm, and preferably greater than 6 mm in the parts which may be in contact with the electrolyte. In an opposite case the capillarity forces can retain some electrolytes in the channel labyrinths.

The channel labyrinths can be constructed also on the basis of tube sections being situated over and under the cap and it is advantageous to choose a form that renders an easy electric coupling of the electrodes and the contacts possible.

In an overturned position of the cell the electrolyte inundates the contacts in the channel labyrinths or on the cap on the side of the gas space, therefore an outer electric circuit may be closed. The electric signal in the outer electric circuit can be used for signalization of the overturned position. In this way the electrolysis can be automatically cut off and the danger will be avoided that the high-pressure of the produced gases forces out the electrolyte from the cell.

BRIEF DESCRIPTION OF THE DRAWINGS

Further objects, features and advantages of the invention will become better understood by the following detailed description when considered in conjunction with the accompanying drawings, wherein FIG. 1. is a horizontal longitudinal cross-section of the presently invented electrolytic cell, FIG. 2. is a vertical longitudinal cross-section of a channel labyrinth in a cap of a vessel of the presently invented electrolytic cell, FIG. 3. is a cross-section of a channel labyrinth in two overturned positions of an embodiment of the presently invented electrolytic cell of FIG. 2., FIG. 4. is a lateral view of an other feature of the presently invented electrolytic cell wherein the channel labyrinths are constructed in the form of tube sections connected with the cap, and FIG. 5. is a top view of the embodiment being shown in FIG. 4.

DESCRIPTION OF THE PREFERRED EMBODIMENTS

Figure 1:
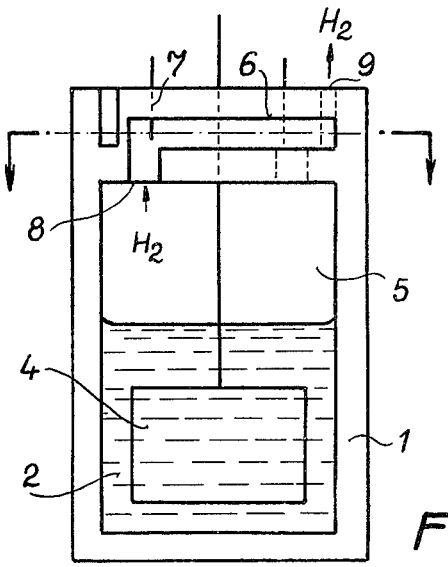
Figure 2:
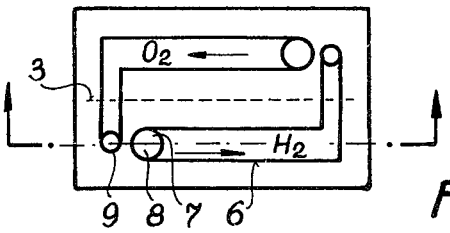

The presently invented electrolytic cell (FIG. 1.) comprises a vessel 1 produced advantageously from a plastic. The vessel 1 comprises acidic or alkaline water electrolyte 2 up to the half of its height and a wall 3 which separates the inner volume of the vessel 1 into a cathode space and an anode space over the electrolyte 2, both forming a part of a gas space 5. The cell comprises also an anode and a cathode 4 for producing hydrogen and oxygen. The gas space 5 is closed by a cap of the vessel 1 and by a channel labyrinth 6 comprising an inlet orifice 8 and an outlet orifice 9. In the vicinity of the inlet orifice 8 contacts 7 are placed in the channel labyrinth 6 or in the cap of the vessel 1. In the embodiment of FIG. 1. the vessel 1 is closed by a channel labyrinth 6 in two parts, of which the first serves for guiding the produced hydrogen and the second for guiding the oxygen. The parts of the channel labyrinth 6 consist of two horizontal and two vertical tube sections (FIG. 2.) extending from the inlet orifice 8 to the outlet orifice 9.

Figure 3:
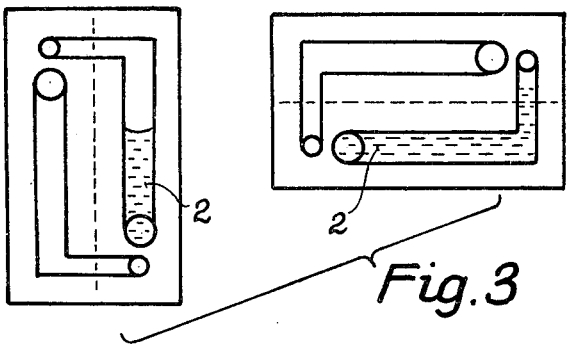

The presently invented electrolytic cell is shown in FIG. 3. in overturned position. The electrolyte 2 can inundate only one of the channel labyrinths 6 of the overturned cell. and it never reaches the level of the outlet orifice 9. The contacts 7 are in this way coupled through the electrolyte 2 to each other and an outer electric circuit can be closed for generating an electric signal usable for automatical cutting out the electrolysis current and for signalization of the overturned position of the cell.

The preferred embodiments of the FIGS. 1., 2. and 3. relate to a solution of the presently invented electrolytic cell wherein the channel labyrinths 6 are placed in the cap of the vessel 1.

Figure 4:
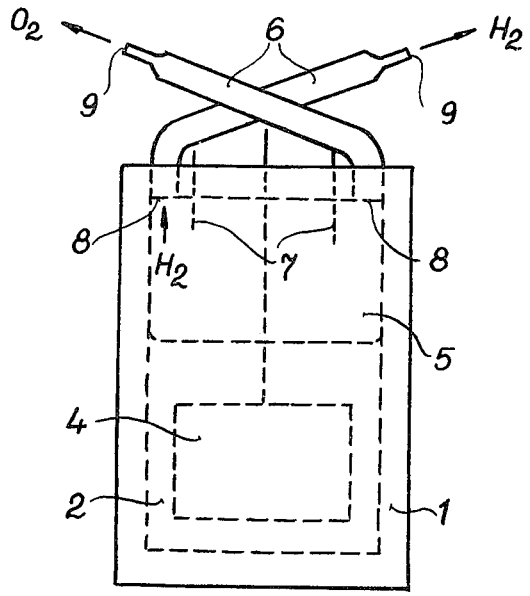
Figure 5:
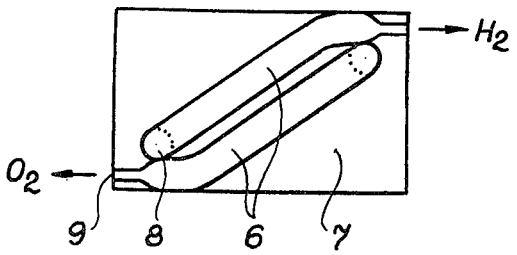

The channel labyrinths 6 can be formed also by tubes connected with the cap of the vessel 1 (FIG. 4. and FIG. 5.). In this case the contacts 7 are placed on the cap on the side of the gas space 5 for detecting the presence of the electrolyte. (The wall 3 for separating the anode space and the cathode space is not shown in FIG. 4. or in FIG, 5.).

The presently invented electrolytic cell can be advantageously used in portable devices. In overturned position of the cell the electrolyte 2 inundates the channel labyrinths 6 and with them also the contacts 7, but can not flow out from the cell. In this way the danger is avoided that the alkaline or acidic electrolyte of the electrolytic cell can ruin the cell or an outer instrument. In overturned position of the cell the contacts 7 generate an electric signal.

Specific representative embodiments and refinements thereto have been discussed in the foregoing passages for the purpose of illustration, but it will be apparent to one skilled in the art that various changes and modifications may be made thereto without departing from the spirit and scope of this invention.

What we claim is:

1. A portable gas producing electrolytic cell, comprising a vessel adapted to contain an electrolyte and having a closed bottom and an open top, a wall dividing the interior of the vessel into anode and cathode chambers that communicate with each other below the surface of the electrolyte, a cap covering the open top of the vessel and substantially hermetically separatting the upper portions of the anode and cathode chambers from each other, gas passageways in said cap for each of said anode and cathode chambers, said passage for the cathode chamber extending over the anode chamber and said passage for the anode chamber extending over the cathode chamber, whereby when the cell is overturned on its side so that either the anode chamber is lowermost or the cathode chamber is lowermost, electrolyte cannot escape from the cell.

2. A cell as claimed in claim 1, in which said vessel is rectangular as seen from above, and said passages open into their respective chambers at diagonally opposite corners of the cell and extend over the cell to corners which are diagonally opposite the respective first-mentioned corners.

3. A cell as claimed in claim 1, in which said passages are greater in diameter than 3 mm.

4. A cell as claimed in claim 3, in which said passages are greater in diameter than 6 mm.

5. A cell as claimed in claim 1, wherein each of said passages has vertical and horizontal portions.

6. A cell as claimed in claim 5, in which said horizontal portions are each in two parts at right angles to each other.

7. A cell as claimed in claim 1, said passages terminating in gas outlets disposed over said cap.

8. A cell as claimed in claim 1, and sensing elements disposed in said passages and adapted to sense the presence of electrolyte therein, to signal the overturn of the cell.

* * * * *